United States Patent [19]

Kobayashi et al.

[11] Patent Number: 4,475,517

[45] Date of Patent: Oct. 9, 1984

[54] AIR-FUEL RATIO CONTROL METHOD AND APPARATUS FOR AN INTERNAL COMBUSTION ENGINE

[75] Inventors: Nobuyuki Kobayashi, Toyota; Hiroshi Itoh, Nagoya; Yoichi Sugiura, Okazaki, all of Japan

[73] Assignee: Toyota Jidosha Kabushiki Kaisha, Toyota, Japan

[21] Appl. No.: 407,559

[22] Filed: Aug. 12, 1982

[30] Foreign Application Priority Data

Aug. 13, 1981 [JP] Japan ..... 56-125988

[51] Int. Cl.[3] ..... F02M 7/00

[52] U.S. Cl. ..... 123/489

[58] Field of Search ..... 123/440, 489, 491

[56] References Cited

U.S. PATENT DOCUMENTS

| | | | |
|---|---|---|---|
| 4,111,162 | 9/1978 | Norimatsu et al. | 123/440 X |
| 4,153,022 | 5/1979 | Asano et al. | 123/440 |
| 4,163,433 | 8/1979 | Fujishiro | 123/440 |
| 4,306,529 | 12/1981 | Chiesa et al. | 123/489 X |

*Primary Examiner*—Tony M. Argenbright

*Attorney, Agent, or Firm*—Cushman, Darby & Cushman

[57] ABSTRACT

The proportion constant for proportional calculation and/or the integration time-constant for integral calculation with respect to the air-fuel ratio correction factor is changed in accordance with the engine warm-up condition, and the fuel-feeding rate is controlled in accordance with the calculated air-fuel ratio correction factor.

8 Claims, 6 Drawing Figures

30
MPU
62
RAM
68
ROM
70
I/O
66
FUEL - INJECTION VALVE
26
72
60
ADC
64
I/O
63
COMPARATOR
40
48
38
52
44
45
18
AIR-FLOW SENSOR
46
COOLANT-TEMPERATURE SENSOR
36
O2 SENSOR
50
THROTTLE-POSITION SWITCH
42
CRANK-ANGLE SENSOR
43
CRANK-ANGLE SENSOR

110
IS $F_T$=1 ?
NO
YES
AT EVERY 50msec
111
$F_T$ ← 0
ADR ← N
112
113
IS $F_{SK}$=1 ?
NO
YES
114
ADR ← M
$F_{SK}$ ← 0
115
116
IS THW 70°C ?
NO
YES
ADR ← ADR+4
117
118
IS $F_{TH}$=1 ?
YES
NO
ADR ← ADR+2
119
120
IS $F_{LN}$=1 ?
NO
YES
121
READ OUT ΔFAF AT ADR
124
FAF ← FAF+ ΔFAF/B
122
ADR ← ADR+1
123
READ OUT ΔFAF AT ADR
FAF ← FAF− ΔFAF/B
125
STORE FAF IN RAM
126

AIR-FUEL RATIO CONTROL METHOD AND APPARATUS FOR AN INTERNAL COMBUSTION ENGINE

BACKGROUND OF THE INVENTION

The present invention relates to an air-fuel ratio closed-loop control method and apparatus for an internal combustion engine.

It is a well-known practice to provide an internal combustion engine with an air-fuel ratio closed-loop control system. Such a system calculates a proportional plus integral value of a detection signal fed from a concentration sensor to form an air-fuel ratio (A/F) correction factor. The sensor detects the concentration of a particular component contained in the exhaust gas. An example of such a sensor is an oxygen ($O_2$) sensor for detecting the concentration of oxygen in the exhaust gas. The air-fuel ratio closed-loop control system corrects the feeding rate of the fuel injected into the engine according to the calculated A/F correction factor so as to control the air-fuel ratio at the desired value.

According to conventional air-fuel ratio closed-loop control, however, as the proportion constant and the integration time-constant for calculating the proportional plus integral value of the detection signal from the $O_2$ sensor are fixed predetermined constants, it is very difficult to always execute optimum air-fuel ratio closed-loop control irrespective of the change in the engine-operating condition. For example, when the engine is fully warmed-up, the air-fuel ratio should be more quickly controlled than when the engine is being warm-up so as to improve the emission control characteristics and engine response. However, according to prior air-fuel ratio control, the control speed of the closed-loop is always maintained at a constant.

SUMMARY OF THE INVENTION

It is, therefore, an object of the present invention to provide an air-fuel ratio control method and apparatus whereby highly accurate and optimum air-fuel ratio closed-loop control can always be executed.

According to the present invention, at least the proportion constant for proportional calculation or the integration time-constant for integral calculation with respect to the air-fuel ratio correction factor is changed in accordance with the engine warm-up condition.

It is preferred that the above-mentioned proportion constant be made greater when the engine is fully warmed-up than when the engine is cold and that the above-mentioned integration time-constant be made smaller when the engine is fully warmed-up than when the engine is cold.

The above and other related objects and features of the present invention will be apparent from the description of the present invention set forth below, with reference to the accompanying drawings, as well as from the appended claims.

DETAILED DESCRIPTION OF THE PREFERRED EMBODIMENT

Figure 1:
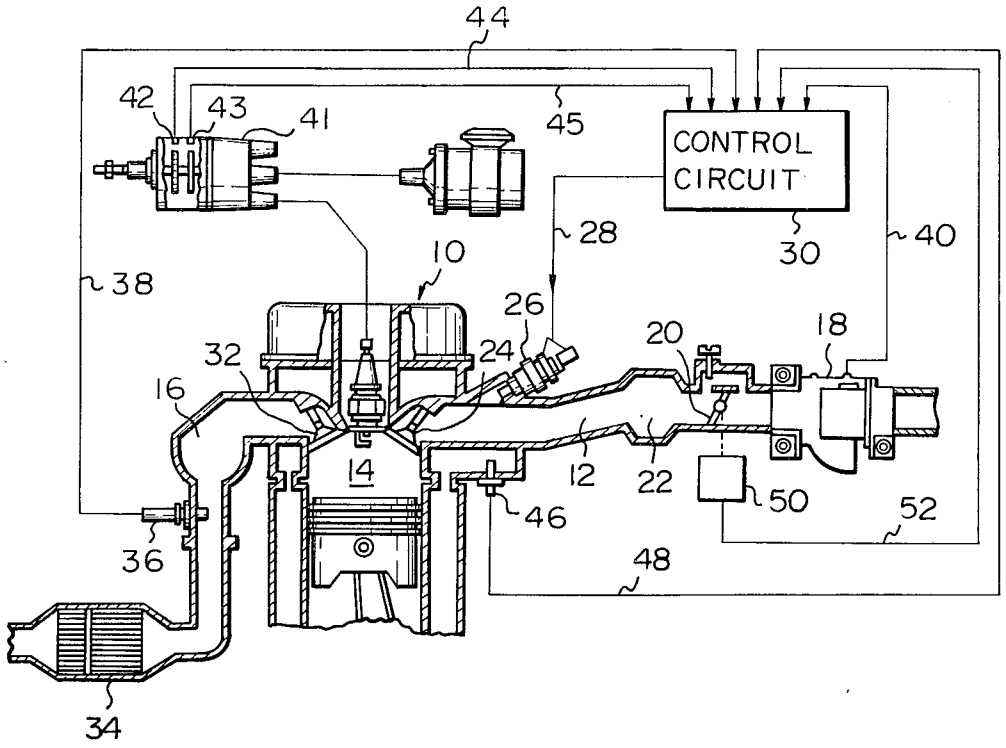
FIG. 1 is a schematic diagram illustrating an air-fuel ratio control system of an internal combustion engine in which the present invention is used.

In FIG. 1, reference numeral 10 denotes an engine body, 12 an intake passage, 14 a combustion chamber, and 16 an exhaust passage. The flow rate of intake air introduced through an air cleaner, which is not shown, is measured by an air-flow sensor 18. The intake-air flow rate is controlled by a throttle valve 20 interlocked with an accelerator pedal which is not shown. The intake air passing through the throttle valve 20 is introduced into the combustion chamber 14 via a surge tank 22 and an intake valve 24.

Each of fuel-injection valves 26 for the respective cylinders is opened and closed in response to electrical drive pulses that are fed from a control circuit 30 via a line 28. The fuel-injection valves 26 intermittently inject into the intake passage 12 in the vicinity of the intake valve 24 compressed fuel that is supplied from a fuel supply system which is not shown.

The exhaust gas which is produced due to combustion in the combustion chamber 14 is emitted via an exhaust valve 32, the exhaust passage 16, and the catalytic converter 34.

An oxygen sensor 36 mounted on the exhaust passage 16 detects the concentration of the oxygen component in the exhaust gas and produces a detection signal depending upon the detected concentration. The detection signal from the $O_2$ sensor 36 is fed to the control circuit 30 via a line 38.

The air-flow sensor 18 is mounted in the intake passage 12 at a position upstream of the throttle valve 20 to detect the intake-air flow rate. The detection signal from the air-flow sensor 18 is fed to the control circuit 30 via a line 40.

Crank-angle sensors 42 and 43 disposed in a distributor 41 produce pulse signals at every crank angle of 30° and 720°, respectively. The pulse signals produced at every crank angle of 30° are fed to the control circuit 30 via a line 44, and the pulse signals produced at every crank angle of 720° are fed to the control circuit 30 via a line 45.

A coolant-temperature sensor 46 detects the temperature of the coolant in the engine. The output signal from the coolant-temperature sensor 46 is fed to the control circuit 30 via a line 48.

A throttle-position switch 50, interlocked with the throttle valve 20, produces a throttle-position signal which indicates whether or not the throttle valve 20 is in the fully closed position. The throttle-position signal from the throttle-position switch 50 is fed to the control circuit 30 via a line 52.

Figure 2:
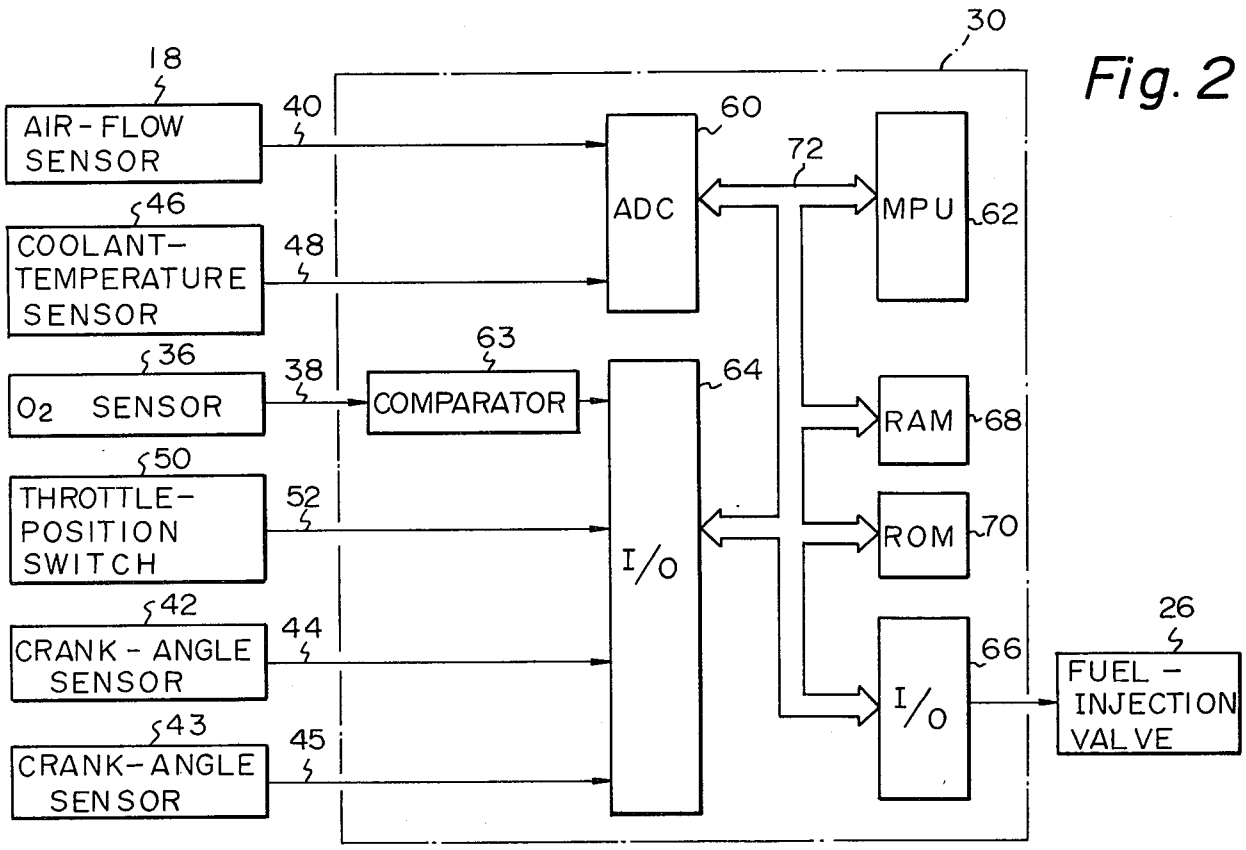
FIG. 2 is a block diagram illustrating the control circuit shown in FIG. 1.

FIG. 2 illustrates an embodiment of the control circuit 30 shown in FIG. 1. In FIG. 2, the air-flow sensor 18, $O_2$ sensor 36, coolant-temperature sensor 46, throttle-position switch 50, crank-angle sensors 42 and 43, and fuel-injection valve 26 for each cylinder are represented by blocks, respectively.

Signals from the air-flow sensor 18 and the coolant-temperature sensor 46 are fed to an analog-to-digital (A/D) converter 60, which contains an analog multiplexer, and are sequentially converted into signals in the form of binary numbers in response to instructions from a microprocessor (MPU) 62.

The detection signal from the $O_2$ sensor 36 is fed to a comparator 63 and is compared with a reference signal. The comparator 63 produces an air-fuel ratio (A/F) signal having a level of "1" or "0" which indicates whether the air-fuel ratio in the engine is on the rich side or on the lean side with respect to the stoichiometric condition where the air-fuel ratio is about 14.6. The A/F signal from the comparator 63 is fed to an input-output (I/O) circuit 64.

A throttle-position signal of one bit having a level of "1" or "0" from the throttle-position switch 50, which signal indicates whether or not the throttle valve 20 is fully closed is fed to the I/O circuit 64.

The pulse signals produced by the crank-angle sensor 42 at every crank angle of 30° are fed to the MPU 62 via the I/O circuit 64 as interrupt-request signals from the interruption routine of every 30° crank angle. The pulse signals from the crank-angle sensor 42 are further fed to a timing counter, which is disposed in the I/O circuit 64, as counting pulses. The pulse signals produced by the crank-angle sensor 43 at every crank angle of 720° are used as reset pulses of the above timing counter.

In the I/O circuit 66, a register which receives output data corresponding to a fuel-injection pulse width of $\tau$ from the MPU 62, a binary counter which starts the counting operation with respect to clock pulses when fuel-injection initiation pulses are fed from the I/O circuit 64 to the binary counter, a binary comparator for comparing the contents in the above register and binary counter, and a driver are provided. The binary comparator produces an injection pulse signal of "1" level from the time when the fuel-injection initiation pulse is supplied thereto until the contents in the binary counter coincide with the contents in the register. Therefore, the injection pulse signal produced by the binary comparator has a pulse width of $\tau$. The injection pulse signal is fed to the fuel-injection valve 26 via the driver. The fuel-injection valve 26 thus injects into the engine a quantity of fuel corresponding to the pulse width of $\tau$ of the injection pulse signal.

The A/D converter 60 and the I/O circuits 64 and 66 are connected via a bus 72 to the MPU 62, a random access memory (RAM) 68, and a read only memory (ROM) 70 which constitute the microcomputer. The data are transferred via the bus 72.

In the ROM 70 are stored beforehand routine programs for main processing and interrupt processing and various types of data which is necessary for carrying out arithmetic calculations.

Hereinafter, the operation of the microcomputer will be illustrated with reference to the flow diagrams of FIGS. 3, 4, 5, and 6.

Figure 3:
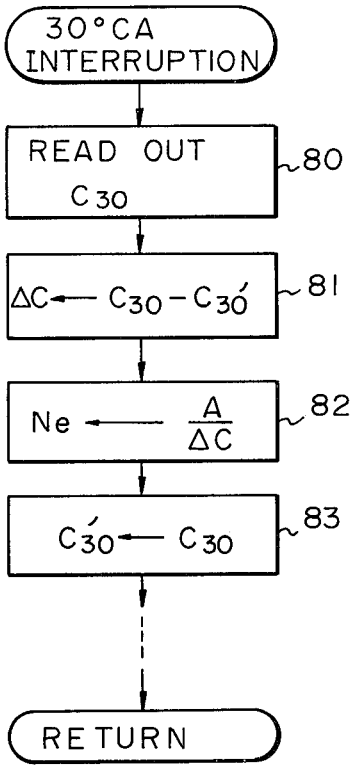
FIGS. 3, 4, 5, and 6 are flow diagrams of control programs according to the present invention.

When the MPU 62 receives a pulse signal at every crank angle of 30° from the crank-angle sensor 42, the MPU 62 executes the interrupt-processing routine shown in FIG. 3 for producing rpm data which indicates actual rotational speed $N_e$ of the engine.

At point 80, the contents in the free-run counter provided in the MPU 62 are read out and temporarily stored in the register in the MPU 62 as $C_{30}$. At point 81, the difference $\Delta C$ between contents $C_{30}$ of the free-run counter, which contents are read out in the present interruption cycle, and contents $C_{30}'$ in the free-run counter, which contents were read out in the last interruption cycle, is calculated from the equation $\Delta C = C_{30} - C_{30}'$. Then, at point 82, the reciprocal of the difference $\Delta C$ is calculated to obtain rotational speed $N_e$. Namely, at point 82, calculation of $N_e = (A/\Delta C)$ is executed, where A is a constant. Calculated $N_e$ is stored in the RAM 68. At point 83, contents $C_{30}$ in the present interruption cycle are stored in the RAM 68 as contents $C_{30}'$ of the free-run counter in the last interruption cycle and are used in the next interruption cycle. Thereafter, another process is executed in the interrupt-processing routine and then the program returns to the main-processing routine.

The MPU 62 further receives a binary signal which indicates intake-air flow rate Q and a binary signal which indicates coolant temperature THW from the A/D converter 60 in response to the interrupt request which occurs at every completion of A/D conversion. The MPU 62 stores the received binary signals in the RAM 68.

Figure 4:
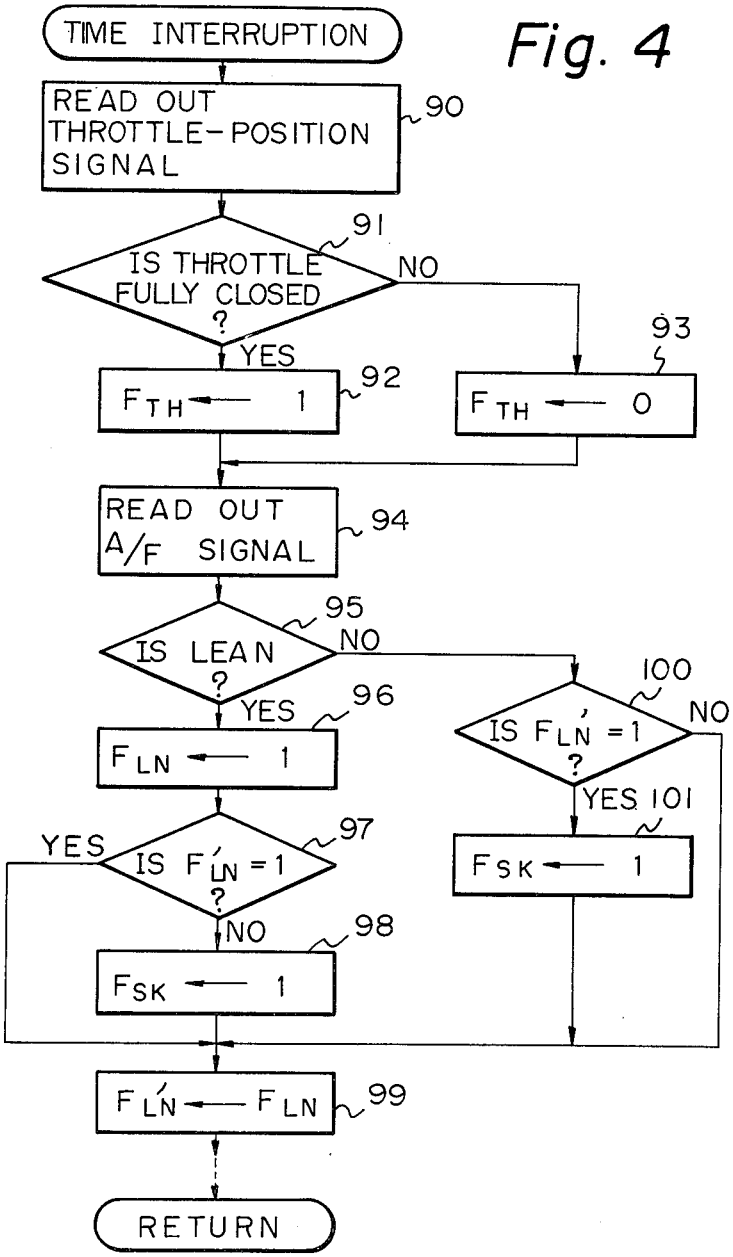

When an interrupt request occurs at predetermined intervals, for example, at intervals of 4-msec, the MPU 62 executes the interrupt-processing routine shown in FIG. 4.

At point 90, first, the MPU 62 accesses the I/O circuit 64 to read out the throttle-position signal from the throttle-position switch 50. Then at point 91, the MPU 62 discriminates whether the throttle valve 20 is in fully closed position in accordance with the throttle-position signal. If "yes" (fully closed), the program proceeds to point 92 where an idle flag $F_{TH}$ is set to "1". Contrary to this, if "no" (open), the program proceeds to point 93 where the idle flag $F_{TH}$ is reset to "0".

At point 94, the MPU 62 accesses again the I/O circuit 64 to read out the A/F signal from the comparator 63. Then, the MPU 62 discriminates whether the air-fuel ratio in the engine is on the rich side or on the lean side with respect to the stoichiometric condition in accordance with the A/F signal at point 95. If the air-fuel ratio is on the lean side, the program proceeds to point 96 where a lean flag $F_{LN}$ is set to "1". Then, at point 97, the MPU 62 discriminates whether a lean flag $F_{LN}'$ formed in the last interrupt cycle is "1" or not. If "no" at point 97, that is, if the lean flag $F_{LN}$ in the present interrupt cycle is "1" and the lean flag $F_{LN}'$ in the last interrupt cycle is "0", the program proceeds to point 98 where a skip flag $F_{SK}$ is set to "1". In other words, the skip flag $F_{SK}$ is set to "1" when the A/F signal changes from the level of "1", which indicates a rich air-fuel condition, to the level of "0", which indicates a lean air-fuel condition. Then, at point 99, the lean flag $F_{LN}$ in the present interrupt cycle is stored in the RAM 68 as the lean flag $F_{LN}'$ in the last interrupt cycle. Thereafter, a successive process according to the interrupt-processing routine is executed and then the program returns to the main processing routine.

If it is discriminated, at point 95, that the air-fuel ratio is not lean (i.e., that it is rich), the program proceeds to point 100 where the same process as at point 97 is executed. Namely, at point 100, whether the lean flag $F_{LN}'$ formed in the last interrupt cycle is "1" or not is discriminated. If $F_{LN}'$="1", namely, if the A/F signal changes from the level of "0", which indicates a lean air-fuel condition, to the level of "1", which indicates a rich air-fuel condition, the program proceeds to point 101 where the skip flag $F_{SK}$ is set to "1".

The above-mentioned lean flag $F_{LN}$ and skip flag $F_{SK}$ are initialized to zero ($F_{LN}$="0", $F_{SK}$="0") in the initial processing routine.

Figure 5:
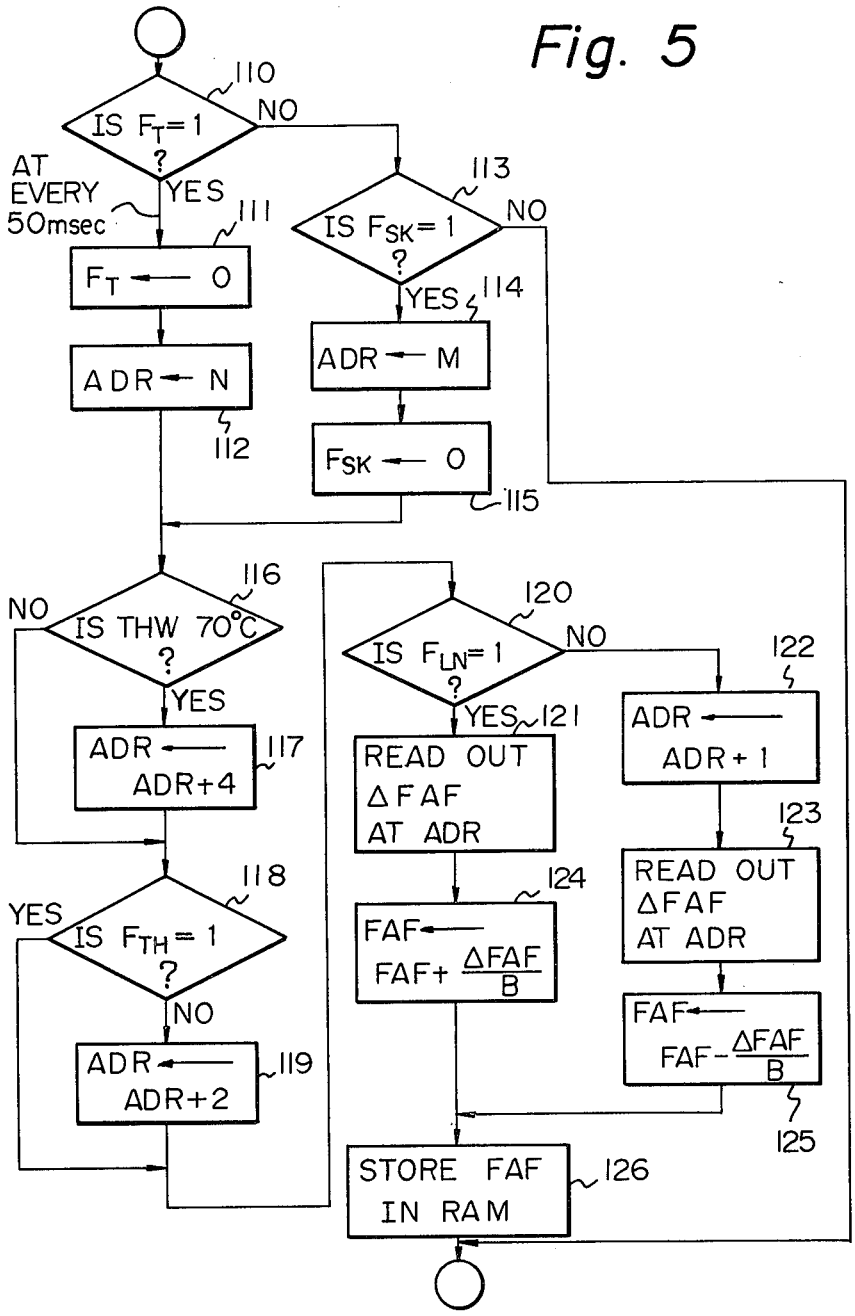

During the main processing routine, the MPU 62 executes the process shown in FIG. 5 for calculating A/F correction factor FAF.

At point 110, the MPU 62 checks whether a timer flag $F_T$ is "1" or not. The timer flag $F_T$ is set to "1" at predetermined intervals, for example, at intervals of 50 msec. If $F_T$="1", the program proceeds to point 111 where the timer flag $F_T$ is reset to "0". Therefore, the process at point 111 and point 112 is executed at 50-msec intervals. Each 50-msec interval corresponds to a period of time for stepwisely changing an A/F correction factor FAF so as to execute integral calculation with respect to the A/F correction factor FAF.

At point 112, address number an ADR is equalized with a predetermined number N. In the ROM 70 is provided beforehand a memory area for an integration table with respect to the integration-time constant and for a skip table with respect to the proportion constant. The above-mentioned number N corresponds to a leading address of the integration table.

On the other hand, if it is discriminated that $F_T \neq 1$ at point 110, the program proceeds to point 113. At point 113, it is discriminated whether the skip flag $F_{SK}$ is "1" or not. If $F_{SK} \neq$ "1", the program passes the following points shown in FIG. 5 and proceeds to a point in the main routine next to point 126. If $F_{SK} \neq$ "1", the program proceeds to point 114 where the address number ADR is equalized with a predetermined number M. Then at point 115, the skip flag $F_{SK}$ is reset to "0". The above-mentioned number M corresponds to a leading address of the skip table.

According to the above-mentioned process at points 110 to 115, the address number ADR is equalized with the leading address N of the integration table in the ROM 70 at 50-msec intervals so as to execute integral calculation with respect to the A/F correction factor FAF. Furthermore, the address number ADR is equalized with the leading address M of the skip table in the ROM 70 when the skip flag $F_{SK}$ is "1", namely when the A/F signal changes from "0" to "1" or "1" to "0", so as to execute proportional calculation (skip calculation) with respect to the A/F correction factor FAF.

At point 116, the MPU 62 reads out the binary signal with respect to the coolant temperature from the RAM 68 and discriminates whether coolant temperature THW is higher than or equal to 70° C. If THW ≧ 70° C., the program proceeds to point 117 where the address number ADR is increased by "4". If THW < 70° C., the program jumps to point 118 and thus the address number ADR is not increased. Therefore, if THW ≧ 70° C., ADR is determined within the range of N+4 to N+7 or M+4 to M+7. If THW < 70° C., ADR is determined within the range of N to N+3 or M to M+3.

At point 118, the MPU 62 discriminates whether the idle flag $F_{TH}$ is "1" or not, namely whether the throttle valve 20 is in the fully closed position or not. If $F_{TH} \neq 1$ (i.e., if the throttle valve 20 is open), the program proceeds to point 119 where the address number ADR is increased by "2". Therefore, in this case ($F_{TH} \neq 1$), ADR is determined as either N+2, N+3, N+6, N+7, M+2, M+3, M+6, or M+7. Contrary to this, if $F_{TH}$="1" (i.e., if the throttle valve 20 is fully closed), since the program jumps to point 120 from point 118, the address number ADR is not increased. Accordingly, ADR is determined as either N, N+1, N+4, N+5, M, M+1, M+4, or M+5.

At point 120, the MPU 62 discriminates whether the lean flag $F_{LN}$ is "1" or not. If $F_{LN}$="1", that is if the air-fuel ratio in the engine is lean, the program proceeds to point 121 where the MPU 62 reads out a changing-amount coefficient ΔFAF at the address of ADR in the interruption table area or in the skip table area in the ROM 70. In this case, the address number ADR is either N, N+2, N+4, N+6, M, M+2, M+4, or M+6.

On the other hand, if it is discriminated that $F_{LN} \neq 1$ at point 120, that is, if the air-fuel ratio is rich, the program proceeds to point 122 where the address number ADR is increased by "1". Then, at point 123, the MPU 62 reads out the changing-amount coefficient ΔFAF at the address of ADR in the integration table area or in the skip table area in the ROM 70. In this case, the address number ADR is either N+1, N+3, N+5, N+7, M+1, M+3, M+5, or M+7.

In each address in the integration table area, each address being referred to as one of the numbers of N to N+7, the respective changing-amount coefficient ΔFAF with respect to the A/F correction factor FAF is stored. Furthermore, in each address in the skip table area, each address being referred to as one of the numbers of M to M+7, the respective changing-amount coefficient ΔFAF is stored. Therefore, the changing-amount coefficient ΔFAF corresponding to the engine parameters of the coolant temperature, throttle position, and A/F is obtained from the integration table during integral calculation and from the skip table during proportional calculation.

Table 1 and Table 2 indicate the integration table and skip table with respect to the engine parameters, respectively. As will be apparent from Table 1 and Table 2, each the changing-amount coefficient ΔFAF during integral calculation and skip calculation is determined in accordance with these engine parameters.

TABLE 1

| Address ADR | Changing-amount Coefficient ΔFAF | Coolant temperature THW | Throttle position | A/F |
|---|---|---|---|---|
| N | 6 | 70° C. > THW | fully closed ($F_{TH}$ = 1) | lean ($F_{LN}$ = 1) |
| N + 1 | 6 | " | " | rich ($F_{LN}$ = 0) |
| N + 2 | 6 | " | open ($F_{TH}$ = 0) | lean ($F_{LN}$ = 1) |
| N + 3 | 6 | " | " | rich ($F_{LN}$ = 0) |
| N + 4 | 6 | 70° C. ≦ THW | fully closed ($F_{TH}$ = 1) | lean ($F_{LN}$ = 1) |
| N + 5 | 6 | " | " | rich ($F_{LN}$ = 0) |
| N + 6 | 12 | " | open ($F_{TH}$ = 0) | lean ($F_{LN}$ = 1) |
| N + 7 | 9 | " | " | rich ($F_{LN}$ = 0) |

TABLE 2

| Address ADR | Changing-amount Coefficient ΔFAF | Coolant temperature THW | Throttle position | A/F |
|---|---|---|---|---|
| M | 20 | 70° C. > THW | fully closed ($F_{TH}$ = 1) | lean ($F_{LN}$ = 1) |
| M + 1 | 20 | " | " | rich ($F_{LN}$ = 0) |
| M + 2 | 20 | " | open ($F_{TH}$ = 0) | lean ($F_{LN}$ = 1) |

TABLE 2-continued

| Address ADR | Changing-amount Coefficient ΔFAF | Coolant temperature THW | Throttle position | A/F |
|---|---|---|---|---|
| M + 3 | 20 | " | " | rich ($F_{LN}$ = 0) |
| M + 4 | 20 | 70° C. ≦ THW | fully closed ($F_{TH}$ = 1) | lean ($F_{LN}$ = 1) |
| M + 5 | 20 | " | " | rich ($F_{LN}$ = 0) |
| M + 6 | 30 | " | open ($F_{TH}$ = 0) | lean ($F_{LN}$ = 1) |
| M + 7 | 30 | " | " | rich ($F_{LN}$ = 0) |

At point 124, then, the A/F correction factor FAF is increased by (ΔFAF/B), where B is a constant. Contrary to this, at point 125, the A/F correction factor FAF is decreased by (ΔFAF/B). Namely, the A/F correction factor FAF is increased when A/F is lean and is decreased when A/F is rich. Changing amount (ΔFAF/B) per one increase or decrease step of the A/F correction factor FAF sometimes varies depending upon the engine parameters. The air-fuel ratio correction factor FAF should be initialized to "1.0" when air-fuel ratio closed-loop control is started.

After the process at point 124 or 125 is completed, the program proceeds to point 126 where the calculated A/F correction factor FAF is stored in the RAM 68.

Accordingly to the above-mentioned processing routine of FIG. 5, the changing amount (ΔFAF/B) of the A/F correction factor FAF according to each increase or decrease step is varied in accordance with the coolant temperature THW, the throttle position, and the air-fuel ratio condition as shown in Table 1 and Table 2. Especially, while the throttle valve 20 is open, the changing amount (ΔFAF/B) according each increase or decrease step when THW≧70° C., is controlled larger than that when THW<70° C.

As will be apparent from Table 1, since the integration table is addressed at 50-msec intervals, the changing amount (ΔFAF/B) determined based upon the integration table corresponds to the integration time-constant of integral calculation for calculating the integral value of the A/F signal. The larger the changing amount (ΔFAF/B), the smaller the integration time-constant. Furthermore, since the skip table (Table 2) is addressed each time the air-fuel ratio changes from rich to lean and vice versa, the changing amount (ΔFAF/B) determined based upon the skip table corresponds to the proportional constant of proportion calculation for calculating the proportional value of the A/F signal. The larger the changing amount (ΔFAF/B), the larger the proportion constant.

Figure 6:
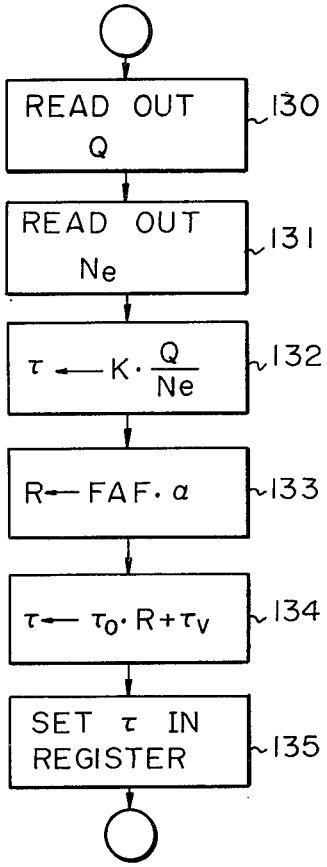

FIG. 6 illustrates a processing routine for calculating the fuel-injection pulse width of $\tau$ in accordance with the thus-calculated A/F correction factor FAF.

During the main processing routine, the MPU 62 executes the process shown in FIG. 6. At points 130 and 131, the MPU 62 reads out the data related to intake-air flow rate Q and rotational speed $N_e$ from the RAM 68, respectively. At point 132, the MPU 62 calculates the basis fuel-injection pulse width of $\tau_0$ of the injection pulse fed to the fuel-injection valve 26 according to the equation $$\tau_0 = K \cdot \frac{Q}{N_e}$$

where K is a constant. At point 133, a total-increment factor R is calculated using the A/F correction factor FAF calculated by the routine shown in FIG. 5 and an another increment factor $\alpha$ from the equation $$R = FAF \cdot \alpha.$$

Then, at point 134, a fuel-injection pulse width of $\tau$ is calculated from the equation $$\tau = \tau_0 \cdot R + \tau_V$$

where $\tau_V$ is a value that corresponds to the ineffective injection pulse width of the fuel-injection valve 26. The data which corresponds to the thus-calculated fuel-injection pulse width of $\tau$ is set at point 135 in the aforementioned register in the I/O circuit 66. Accordingly, fuel at a feeding rate corresponding to the pulse width of $\tau$ is injected into the engine.

As illustrated in detail in the foregoing, according to the present invention, at least the proportion constant for proportional calculation (skip calculation) or the integration time-constant for integral calculation with respect to the A/F correction factor is changed in accordance with the engine warm-up condition. Therefore, optimum air-fuel ratio closed-loop control can always be executed irrespective of the change in the engine-operating condition. As a result, the accuracy of air-fuel ratio control can be improved, and, furthermore, the emission control characteristics and engine response can be greatly improved.

As many widely different embodiments of the present invention may be constructed without departing from the spirit and scope of the present invention, it should be understood that the present invention is not limited to the specific embodiments described in this specification, except as defined in the appended claims.

We claim:

1. An air-fuel ratio control method of an internal combustion engine, comprising the steps of:

detecting the concentration of a predetermined component in the exhaust gas to generate a first electrical signal which indicates whether the air-fuel ratio in the engine is on the rich side or on the lean side with respect to the stoichiometric condition;

detecting the warm-up condition of the engine to generate a second electrical signal which indicates the detected warm-up condition;

calculating a proportional plus integral value of said first electrical signal to produce an air-fuel ratio correction factor which corresponds to said proportional plus integral value, at least one of the proportion constant of proportional calculation and the integration time-constant of integral calculation being changed in accordance with said second electrical signal, so that the proportion constant, when changed, being made greater when the engine is fully warmed-up than when the engine is warming-up, the integration time-constant, when changed, being made smaller when the engine is fully warmed-up than when the engine is warming-up, causing said air-fuel ratio correction factor to change more quickly in response to change of said first electrical signal when the engine is fully warmed-up than when the engine is warming-up; and correcting the feeding rate of the fuel supplied to the engine in accordance with said air-fuel ratio correction factor.

2. A method as claimed in claim 1, wherein said method further comprises a step of detecting the position of the throttle valve of the engine to generate a third electrical signal which indicates whether the throttle valve is open or fully closed, and said calculating step includes a step of changing at least the proportion constant of proportional calculation or the integration time-constant of integral calculation in accordance with said second electrical signal only when said third electrical signal indicates that the throttle valve is open.

3. A method as claimed in claim 1, wherein said calculating step includes a step of changing the integration time-constant of integral calculation in accordance with said first and second electrical signals.

4. A method as claimed in claim 2, wherein said changing step includes a step of changing, in response to said third electrical signal, the integration time-constant of integration calculation so that the integration time-constant is made smaller when the air-fuel ratio is on the lean side than when it is on the rich side.

5. An air-fuel ratio control apparatus of an internal combustion engine, comprising:

means for detecting the concentration of a predetermined component in the exhaust gas to generate a first electrical signal which indicates whether the air-fuel ratio in the engine is on the rich side or on the lean side with respect to the stoichiometric condition;

means for detecting the warm-up condition of the engine to generate a second electrical signal which indicates the detected warm-up condition;

means for calculating a proportional plus integral value of said first electrical signal to produce an air-fuel ratio correction factor which corresponds to said proportional plus integral value, at least one of the proportion constant of proportional calculation and the integration time-constant of integral calculation being changed in accordance with said second electrical signal, so that the proportion constant, when changed, being made greater when the engine is fully warmed-up than when the engine is warming-up, the integration time-constant, when changed, being made smaller when the engine is fully warmed-up than when the engine is warming-up, causing said air-fuel ratio correction factor to change more quickly in response to change of said first electrical signal when the engine is fully warmed-up than when the engine is warming-up; and means for correcting the feeding rate of the fuel supplied to the engine in accordance with said air-fuel ratio correction factor.

6. An apparatus as claimed in claim 5, wherein said apparatus further comprises means for detecting the position of the throttle valve of the engine to generate a third electrical signal which indicates whether the throttle valve is open or fully closed, and said calculating means includes means for changing at least the proportion constant of proportional calculation or the integration time-constant of integral calculation in accordance with said second electrical signal only when said third electrical signal indicates that the throttle valve is open.

7. An apparatus as claimed in claim 5, wherein said calculating means includes means for changing the integration time-constant of integral calculation in accordance with said first and second electrical signals.

8. An apparatus as claimed in claim 6, wherein said changing means includes means for changing, in response to said third electrical signal, the integration time-constant of integration calculation so that the integration time-constant is made smaller when the air-fuel ratio is on the lean side than when it is on the rich side.

* * * * *